US012179123B2

(12) United States Patent
Laffin

(10) Patent No.: US 12,179,123 B2
(45) Date of Patent: Dec. 31, 2024

(54) PARK RIDE WITH DROP SWING PROPULSION

(71) Applicant: DISNEY ENTERPRISES, INC., Burbank, CA (US)

(72) Inventor: Kristopher M. Laffin, Los Angeles, CA (US)

(73) Assignee: Disney Enterprises, Inc., Burbank, CA (US)

( * ) Notice: Subject to any disclaimer, the term of this patent is extended or adjusted under 35 U.S.C. 154(b) by 881 days.

(21) Appl. No.: 17/322,466

(22) Filed: May 17, 2021

(65) Prior Publication Data

US 2022/0362682 A1 Nov. 17, 2022

(51) Int. Cl.

| | |
|---|---|
| ***A63G 31/02*** | (2006.01) |
| ***A63G 21/00*** | (2006.01) |
| ***A63G 27/00*** | (2006.01) |

(52) U.S. Cl.

CPC ..... *A63G 31/02* (2013.01); *A63G 21/00* (2013.01); *A63G 27/00* (2013.01)

(58) Field of Classification Search

CPC ..... A63G 31/02; A63G 21/00; A63G 27/00

See application file for complete search history.

(56) References Cited

U.S. PATENT DOCUMENTS

| | | | | |
|---|---|---|---|---|
| 10,099,148 | B2 * | 10/2018 | Burger | A63G 7/00 |
| 10,814,236 | B1 * | 10/2020 | Dagley | A63G 31/02 |
| 2013/0019771 | A1 * | 1/2013 | Gmeinwieser | A63G 7/00 104/53 |
| 2019/0161099 | A1 * | 5/2019 | Burger | A63G 7/00 |

FOREIGN PATENT DOCUMENTS

CN 203540039 U * 4/2014

* cited by examiner

*Primary Examiner* — Scott A Browne
(74) *Attorney, Agent, or Firm* — Dorsey & Whitney LLP

(57) ABSTRACT

A park ride for use in theme parks, amusement parks, and other settings. The new ride includes a track defining a ride path for a passenger vehicle (or multiple vehicles that may be linked in a train). The vehicle is configured, such as with a bogie assembly with two to four or more wheels, to roll upon and engage the track. The ride includes a drop swing propulsion system that is adapted to drop a section of track upon which the passenger vehicle is supported from a first elevation to a second elevation that is lower than the first elevation. The dropping motion involves swinging the track with a linkage assembly, which with other components of the system may form a four-bar linkage, so as to impart a propelling force on the vehicle to move it along an exit track section provided at the second, lower elevation.

23 Claims, 7 Drawing Sheets

PARK RIDE WITH DROP SWING PROPULSION

BACKGROUND

1. Field of the Description

The present description relates, in general, to rides and ride systems for use in amusement parks, theme parks, and other settings ("park rides"), and, more particularly, to a new park ride (and corresponding operating or control method for such a park ride) that includes one or more sections adapted to provide drop swing propulsion to a one or more passenger vehicles. The new park ride design is particularly well suited for use in roller coasters, water rides, and the like in which vehicles are configured to ride or roll, at least a portion of the time, upon a track.

2. Relevant Background

There is a continuing demand by visitors to amusement and theme parks, as well as other settings where rides are provided, for new and surprising ride experiences. Most existing park rides are based on very old ride designs and configurations with many of the more recent updates being limited to thematic elements including the surrounding scenery, audio and visual effects, and vehicle designs, which do not affect the physical ride experience and sensation itself. Park visitors have very high expectations and demand that rides provide unique experiences to encourage them to return to a park and to go on rides multiple times.

For example, nearly every park or park-like facility includes one or more roller coasters. Park visitors find roller coasters exciting and fun, but many park operators have turned to other rides, such as dark rides, that allow them to push the entertainment envelope using new technologies to advance the ability to provide a storytelling experience. Roller coaster technology has not changed much in the last century in contrast. Riders know beforehand what type of ride experience they are going to have when they get on a roller coaster, even one they have not yet ridden. Similarly, rides such as water rides have become somewhat predictable for park visitors.

Park visitors have very high expectations and demand that rides provide unique experiences to encourage them to return to a park and to go on rides multiple times. Hence, there remains a need for new park ride designs that modify the physical sensation experienced and that change how a vehicle travels along the ride path.

SUMMARY

The inventor recognized that there was a need for a new way to surprise people when they experience a park ride or attraction they think they know such as a roller coaster, a water ride, and so on. To meet this and other needs, the inventor created a new park ride design that includes a track defining a path for a passenger vehicle (or train of such vehicles) that rides on the track.

Within the track, a drop swing propulsion system or assembly is provided that provides a new attraction experience never before seen in theme or amusement parks that is versatile and equips the ride designers with a new tool to advance ride capabilities. The drop swing propulsion system is designed to drop a track section supporting the vehicle(s) from a first height to a second height lower than the first height (e.g., 5 to 20 feet or more change in elevation) and to use the momentum created by this drop to provide propulsion to the vehicle(s). Some embodiments of the drop swing propulsion system are configured to propel the vehicle(s) in the same direction after the drop is experienced while other embodiments of the new system provide a concurrent change in direction for each vehicle.

More particularly, a park ride is provided for propelling a vehicle using a combined drop and swing motion. The ride includes a passenger vehicle configured for rolling upon track components defining a ride path. The ride also includes a load-in track section in the ride path engaging and supporting the passenger vehicle at a first elevation while the vehicle travels in a first direction along the ride path, and the ride also includes a linkage track section. Further, the ride includes a linkage assembly coupled to the linkage track section. Significantly, the linkage assembly first operates to position the linkage track section in a first position at the first elevation that is adjacent the load-in track section to receive and support the passenger vehicle and second operates to drop and swing the linkage track section with the passenger vehicle to a second position, at a second elevation less than the first elevation by a predefined amount, from which the passenger vehicle is released from the load-in track with energy generated by the drop and swing of the linkage track section.

In some preferred embodiments of the park ride, the linkage assembly is configured, in part, as a four-bar linkage that is operated to provide the drop and swing of the linkage track section. In this embodiment, the linkage track section provides a first link of the four-bar linkage, and a base support structure proximate to the second position provides a second link of the four-bar linkage. Further, the four-bar linkage further may include a pair of spaced apart and parallel elongated arms providing third and fourth links of the four-bar linkage, and each of the elongated arms is pivotally coupled at a first end to the base support structure and at a second end to the linkage track section. Further, coupling members can be provided to achieve the pivotal coupling of the elongated arms to the base support structure and to the linkage track section. Then, at least one motor (or other actuator or driver) may be provided for driving rotation of the elongated arms at a desired speed during the drop and swing of the linkage track section.

In some change direction configurations of the ride, the four-bar linkage is rotated through an angle in the range of 90 to 180 degrees during the drop and swing of the linkage track section, and the passenger vehicle is released from the linkage track section traveling in a second direction opposite the first direction. In such configurations, an end stop assembly on the linkage track section is operated to retain the passenger vehicle at an end of the linkage track section distal from the load-in section until the four-bar linkage enters a final 90-degree portion of the drop and swing of the linkage track section. Further, a "careen brake" on the linkage track section can be activated after the passenger vehicle is at an end of the linkage track section distal from the load-in section until a time in the drop and swing of the linkage track section prior to the release of the passenger vehicle with the linkage track section at the second position. In same direction configurations of the park ride, the four-bar linkage is rotated through an angle in the range of 0 to 90 degrees during the drop and swing of the linkage track section, and the passenger vehicle is released from the linkage track section traveling in a second direction matching the first direction.

In roller coaster-type configurations and the like, the ride may include an exit track section at the second elevation. In these implementations, an end of the linkage track section is positioned adjacent to and aligned with an end of the exit track section when the linkage track section is positioned at the second position, whereby the passenger vehicle is released onto the exit track section to travel upon the ride path using the energy generated by the drop and swing of the linkage track section for propulsion.

In other cases, the ride may be implemented as a water ride. In such embodiments, the passenger vehicle is a water ride vehicle (e.g., configured to float on water and also to roll upon a guide track defining a part of the ride path). In such implementations, the park ride further includes a flume or channel of water, and the linkage track section is at least partially submerged in the water of the flume or channel when moved by the drop and swing of the linkage assembly into the second position.

DETAILED DESCRIPTION OF THE PREFERRED EMBODIMENTS

Briefly, the following description describes a park ride for use in theme parks, amusement parks, and other settings. The new park ride includes a track defining a ride path (for at least a portion of the park ride) for a passenger vehicle (or multiple vehicles that may be linked in a train or group). The passenger vehicle is configured, such as with a bogie assembly with two to four or more wheels, to rollably engage the track. Significantly, the park ride includes a drop swing propulsion system that is adapted to drop a section of track upon which the passenger vehicle is supported from a first elevation to a second elevation that is lower than the first elevation.

The dropping motion involves swinging the track with a swing arm assembly, which with other components of the system may form a four-bar linkage (or parallel pair of such linkages), so as to impart a propelling force or to provide propulsion to the passenger vehicle to move along an exit track section provided at the second, lower elevation (note, in water ride embodiments, the exit track section is optional and/or may be replaced with a channel containing water). The drop swing propulsion system may be provided with a direction change configuration or a same direction configuration to propel the passenger vehicle in a different direction (e.g., opposite the incoming direction) or in a like direction, respectively.

Figures 1A, 1B:
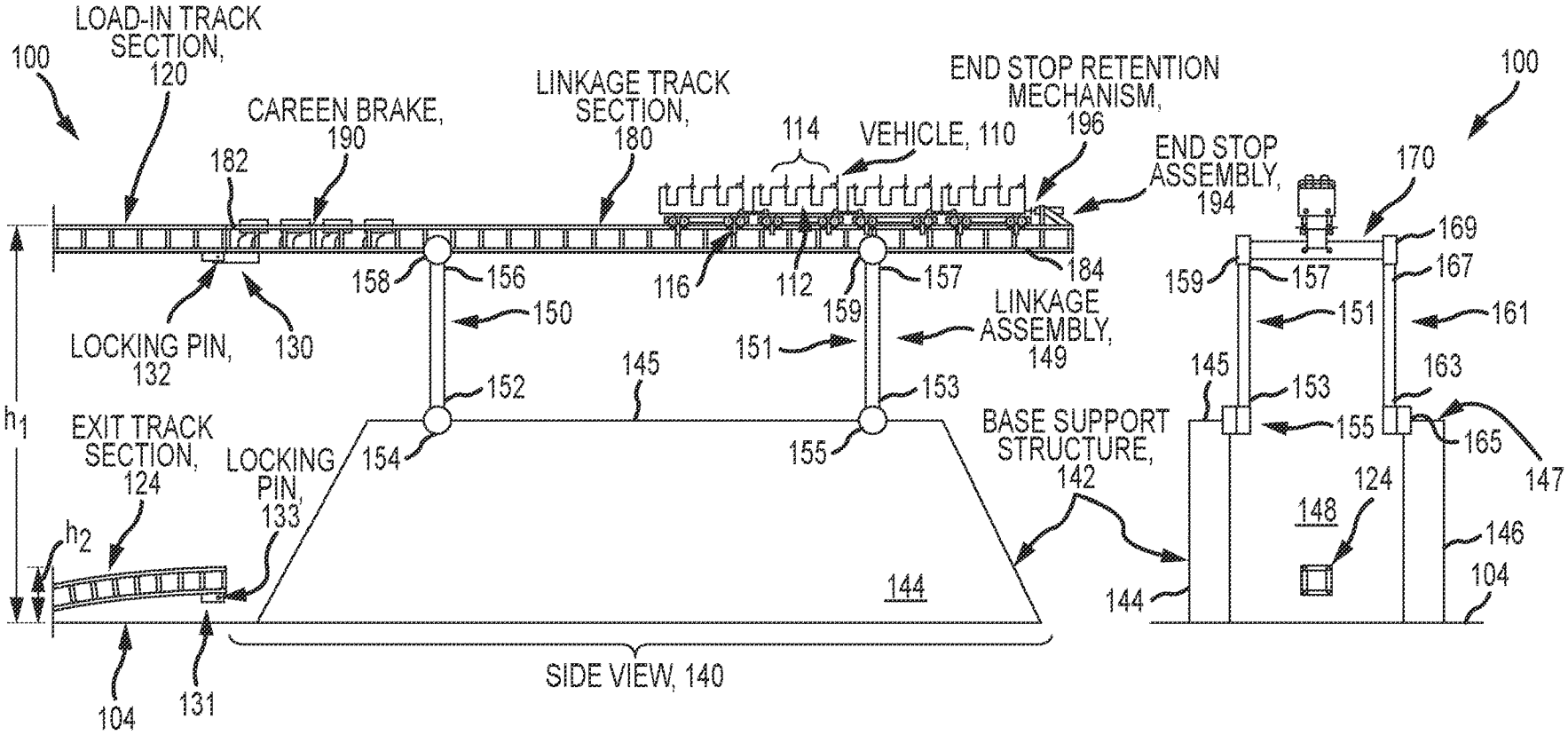
FIGS. 1A and 1B illustrate side and end/rear views, respectively, of a park ride with drop swing propulsion system of the present description with a train of passenger vehicles loaded upon the linkage track section of the drop swing propulsion system.

FIGS. 1A and 1B illustrate side and end/rear views, respectively, of a park ride 100 with drop swing propulsion system 140 of the present description. The ride 100 is shown with a train of passenger vehicles (including passenger vehicle 110) loaded upon the linkage track section 180 of the drop swing propulsion system 140 upon completion of a loading stage of system operation and immediately prior to initiation of the drop and swing stage of system operations.

As shown, the ride 100 includes a base or platform 104 for supporting other components such as with a concrete slab or the like. The park ride 100 is configured to define a ride path for a passenger vehicle 110, and the ride path is defined, at least along a portion of its length, with a track. In FIGS. 1A and 1B, a load-in track section 120 of this track is shown along with an exit track section 124.

The passenger vehicle 110, which is shown to be one of two or more cars of a train but may be provided individually in some embodiments, has a body or chassis 112 upon which are mounted one or more seats (generally any device configured to support and restrain a passenger in the vehicle 110) 114 for receiving one or more passengers. The vehicle 110 is adapted with a bogie or wheel assembly 116 with two or more wheels (with four shown) for riding upon (or rollably engaging) the track of the ride 100 including the track sections 120 and 124, and the bogie 116 and tracks 120, 124 may take any useful configuration known or to be developed in the ride industry for coasters, water rides, and the like (e.g., to allow the vehicle to freely roll in a guided manner while also restraining the vehicle in its horizontal and vertical movements relative to the track sections 120, 124). The embodiment shown in FIGS. 1A and 1B is a direction change configuration, and the vehicle 110 travels along the load-in track section 120 in a first direction (shown) with seats 114 facing a second direction opposite the first direction (as shown to be back along the load-in track section 120) and travels along the exit track section 124 in the second direction (and, in other embodiments, the seats 114 may be facing another direction with the key being a change in direction of the vehicle 110 from a first to a second direction).

The vehicle direction change in the park ride 100 is provided by the inclusion of a drop swing propulsion system 140, and, as discussed herein, the system 140 also provides a change in elevation (a drop) and an application of a propelling force or a propulsion of the vehicle 110 as it enters the exit track section 124 (a swing to provide at least a portion of the drop-providing momentum to the vehicle 110). To provide the drop and swing movements to the vehicle 110, the system (or mechanism) 140 includes a base support structure 142 including a first sidewall 144 extending upward a distance (e.g., five to thirty feet or more to suit length of arms 150, 154) from the upper surface of the base 104 to an upper edge 145 and further including a second sidewall 146 also extending upward a distance (e.g., five to thirty feet or more to suit length of arms 150, 151) from the upper surface of the base 104 to an upper edge 145. The sidewalls 144, 146 may be vertical (extend orthogonal as shown from base 104), although this is not required, and be spaced apart (e.g., some distance greater than a maximum width of the vehicle 110 to support proper safety envelopes for park rides) and parallel to each other to define a channel 148 between their inner surfaces/sides for the vehicle 110 to pass during the swing movement. An exposed or open end of the exit track section 124 is positioned at or near the outlet of the channel 148. The upper edges 145, 147 of the sidewalls 144, 146 are spaced apart and extend parallel to each other in a horizontal plane.

The drop swing propulsion system 140 includes a linkage track section 180 with a length that is at least as long as the maximum length of the vehicle 110 (or train of vehicles 110) but typically significantly more such as four to ten times the maximum length of the vehicle 110. The linkage track section 180 takes a general form similar to that of track sections 120, 124 such that the vehicle 110 can roll upon and be received/retained by the linkage track section 180 after traveling along and off of the load-in track section 120 as shown in FIG. 1A (e.g., with vehicle 110 being shown after loading is complete or nearly so). In the loading stage shown, a first end 182 of the linkage track section 180 is aligned with and coupled to an exposed or open end of the load-in track section 120. The alignment and locking are provided in part with a first track locking assembly 130 such as with a locking pin 132, as shown. For example, locking is actuated and pin moved to a locking position upon sensing of proper alignment and positioning of end 182 with the load-in track section 120. In an exiting or releasing stage (explained in later figures), the end 182 of the linkage track section 180 is aligned and then retained in place against or mated with the open end for the exit track section 124 via operation of a second track locking assembly 131 and positioning (with one or more actuators) of a locking pin(s) 133 upon sensing of proper alignment and relative positioning of the track sections 124, 180.

The system 140 further includes a careen brake or a braking assembly 190 in or near the end 182 of the linkage track section 180 that functions to retain the vehicle 110 in a desired position(s) on the linkage track section 180 after loading and during drop and swing movements of the track section 180. Further, to properly brake and restrain the vehicle 110, the system 140 includes an end stop assembly 194 at a second end 184 of the track section 180 opposite the first end 182. The end stop assembly 194 may include an end stop and one or more absorber devices to brake and reduce the shock of the vehicle 110 contacting the end stop during loading as the vehicle 110 is slowed and stopped from traveling at the speed it was at on the load-in track section 120. Further, the end stop assembly 194 includes an end stop retention mechanism 196 for capturing and restraining/holding the vehicle 110 (or the vehicle in a train closest to the end stop) at the end of the loading stage and, typically, for a first portion of the drop and swing motion. The retention assembly 196 may be actuated to release the vehicle 110, as discussed below, after 90 degrees of a 180-degree drop and swing movement is completed such that vehicle 110 is prevented from rolling away from the end 184 until forces imparted by the downward swing act to hold it in place against the end stop assembly 194.

During the loading stage of operations of the system 140, the linkage track section 180 is supported at a first elevation or height, $h_1$, that matches that of the load-in track section 120. After the drop and swing stage of operations of the system 140, the linkage track section 180 is supported at second elevation or height, $h_2$, that is lower (e.g., a drop of 5 to 30 feet or more is common for ride 100) and that matches that of the open end of exit track section 124. To provide both the track support in both positions and to also provide the drop and swing motion of the linkage track section 180, the drop and swing propulsion system 140 includes a linkage assembly 149.

The linkage assembly 149 may be operate based on and/or include one, two, or more four-bar linkages to provide these two functions. In the side view of FIG. 1A, the linkage assembly 149 is shown to include first and second linkage arms 150, 151 (or bars or links). These are generally elongated members, such as cylindrical rods formed of metal or other useful materials, with a length chosen to provide the amount of drop desired in the park ride 100 (e.g., again 5 to 30 feet or more may be useful for these lengths) and with a diameter to provide the desired component strengths (e.g., a high enough tensile strength to support the track section 180 and loaded vehicle(s) 110 along with a safety factor(s) during the drop and swing movements).

The linkage arms 150, 151 each extend from a first or lower end 152, 153 to a second or upper end 156, 157. The first or lower ends 152, 153 are rotatably coupled/supported upon the upper edge 145 of the support side wall 144 via pivotal coupling members 154, 155, respectively. Likewise, the second or upper ends 156, 157 are rotatably coupled to the linkage track section 180 via pivotal coupling members 158, 159 along with a track connection/support shaft extending between the members 158, 159 and corresponding pivotal coupling members. A single track connection/support shaft 170 is shown in the rear/end view of FIG. 1B, and the shaft 170 is pivotally coupled with the coupling member 159 at one end and with a similar coupling member 169 at a second end.

FIG. 1A shows a four-bar linkage with arms 150, 151 and with track section 180 and support side wall 144 (or its upper edge 145). In this exemplary, but non-limiting, configuration, a matching four-bar linkage would also be provided on the other side of the track section 180 and supported on base 104 via sidewall 146. This is shown in FIG. 1B (at least in part) with a linkage arm 161 that would be arranged parallel to the arm 151 (which is why it is hidden from view in FIG. 1A) and with another arm (not visible in FIGS. 1A and 1B) parallel to the arm 150 and arm 161. As seen in FIG. 1B, the linkage arm 161 extends from a first or lower end 163 that is pivotally coupled via coupling member 165 to the upper edge 147 of the sidewall 146 to a second or upper end 167 that is pivotally coupled via coupling member 169 to the linkage track section 180 via the track connection/support shaft 170.

One-to-all of the pivotal coupling members 154, 155, 158, 159, 165, and 169 may be actuated or motorized such that in combination (or with concurrent operations) they can return the linkage assembly from the dropped (and vehicle released) stage of operations back to the loading stage (and vehicles to be or having been loaded) shown in FIGS. 1A and 1B. The actuators/motors provided may also be used braking or controlling the rate of arm motion during drop and swing operations (or a separate braking component may be used in the coupling members or provided separately) while other embodiments may rely upon or use, in part or full, gravity to provide the drop and swing motion.

The drop swing propulsion system/mechanism 140, as shown in FIGS. 1A and 1B, includes a four-bar linkage mechanism, with two linkage arms or links/bars 150, 151 attached to a base support 144 at the bottom ends 152, 153 and a linkage track section 180 attached to the top ends 156, 157 of the linkage arms 150, 151. Additionally, there is a load-in track section 120 where the vehicle(s) 110 load onto the four-bar linkage track section 180 and an exit track section 124 where the vehicle(s) 110 exit the system/mechanism 140 back onto the main track (not shown but is linked to the load-in track section 120 and the exit track section 124 to further define the ride path of the ride 100).

The drop swing propulsion system 140 is configured to operate so as to allow a vehicle 110 to load onto a track section 110 at some elevation above a lower track section 124 ($h_1$-$h_2$). The upper track section or linkage track 180 is on a four-bar linkage assembly/mechanism 149 that will allow the track section 180 to rotate and swing down, by means of gravity or driven by actuators/motors while, significantly, keeping the passenger vehicle 110 horizontal during the transition (drop and swing motion), to the elevation, $h_2$, of the exit track section 124. The rotation of the four-bar linkage assembly 149 transfers the potential energy of the elevated vehicle 110 (shown at the first height, $h_1$, in FIGS. 1A and 1B upon loading) into kinetic energy at the bottom of the swing motion, thereby "launching" or propelling the vehicle(s) 110 out of the four-bar linkage assembly 149 at a higher speed (in many implementations) than it entered.

Figure 2:
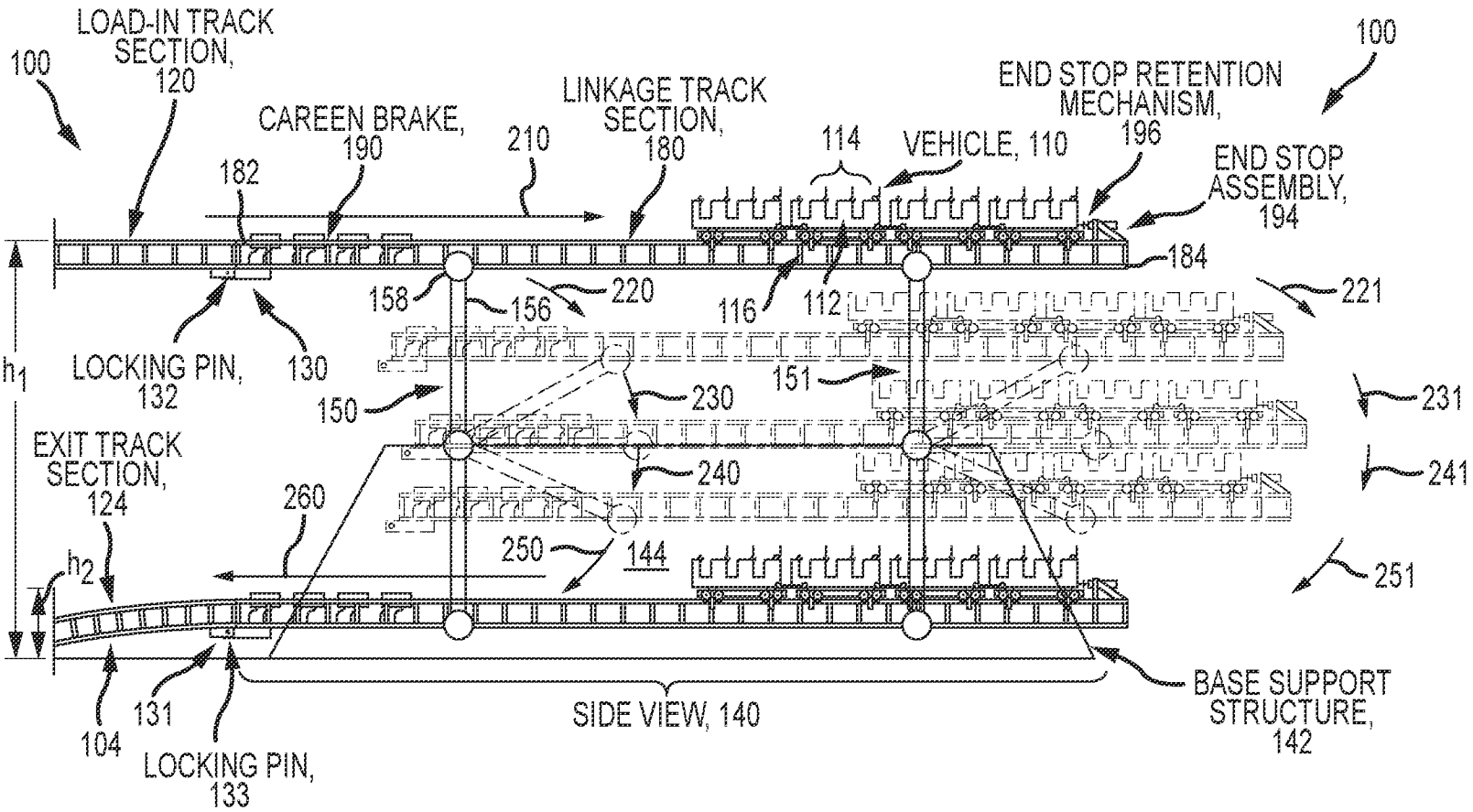
FIG. 2 illustrates the park ride of FIGS. 1A and 1B as the drop swing propulsion system is operated to transition (drop and swing) a loaded train of vehicles from a load-in track section to an exit track section.

As noted above, the embodiment shown in FIGS. 1A and 1B is a direction change configuration of a drop swing propulsion system 140. This configuration allows the vehicle 110 to exit the mechanism/system 140 going or traveling the opposite direction from which it entered the mechanism/system 140. FIG. 2 illustrates the park ride 100 of FIGS. 1A and 1B as the drop swing propulsion system 140 operates to transition (drop and swing movements or motion) a loaded train of vehicles, including passenger vehicle 110, from a first elevation, $h_1$, of a load-in track section 120 to a second, lower elevation, $h_2$, of an exit track section 124. As shown with arrows 210 and 260 in FIG. 2, with a roller coaster-type ride 100, the coaster train with vehicle 110 enters the drop swing propulsion system 140 from the left at a first velocity or speed and exits the system 140, after the drop and swing motion or transition from the higher to the lower elevation, traveling at a second velocity (typically higher than the first velocity) moving toward the left (e.g., moving in an opposite direction as arrows 210 and 260 indicate two opposite directions of travel), thereby changing the initial direction of the vehicle 110. In practice, this means that the vehicle 110 can enter the mechanism/system 140 in a reverse (or forward) orientation with passengers in seats 114 facing away from the direction of travel 210 and leave in a forward (or reverse) orientation with passengers in seats 114 facing toward the direction of travel 260 of the vehicle 110.

Arrows 220 and 221 show the track section 180 with vehicle 110 first being dropped and swung from the initial load position or stage of operation after release, e.g., by movement of the locking pin 132 in first locking assembly 130, to a second, lower elevation with the track section 180 still in a horizontal orientation (parallel to the first, loading orientation). The arrows 230, 231 show movement from this first transition position to a later transition position that is the half way point or position (e.g., after 90 degrees of 180 degrees of motion has occurred). The arrows 240, 241 show further movement to a next or later transition position, and during this transition or drop and swing movement the vehicle train with vehicle 110 often will be released from the end stop assembly 194 via operation of the end stop retention mechanism 196 (any time at or after the 90 degree swing of the links/arms of the four-bar linkage). Finally, arrows 250, 251 show the final movement/motion of the track section 180 during drop and swing operations to place the track section 180 in an abutting and aligned (and captured via second track locking assembly 131 and positioning of locking pin 133) position relative to the open end of exit track section 124. The train with vehicle 110 is propelled by the swinging motions (which impart kinetic energy to the vehicle 110) in a direction and at an exit velocity as shown by arrow 260 out of the mechanism/system 140 onto exit track section 124. Note, as shown in this configuration, the track section 180 is kept in a horizontal plane during the complete drop and swing movement (or transition from the first elevation, $h_1$, to the second elevation, $h_2$).

The system 140 works by allowing the vehicle 110 to move from the load-in track section 120 onto the linkage track section 180. Once the vehicle 110 transfers past the careen brake 190 lead-in end/section 182 of the linkage track section 180, the careen brake 190 is activated to ensure the vehicle 110 (and the train in which it is included) cannot travel to the open end of the track section 180 while the system 140 is moving as shown with arrows 220-231 in FIG. 2. The careen brake 190 may take a variety of forms to practice the system 140 such as any common brake system including pneumatic pinch brakes, eddy current brakes, a combination of the two, or another brake design used to ensure the train with vehicle 110 stays on the track during the rotation 220-231 shown in FIG. 2.

When the train with vehicle 110 approaches the end 184 of the linkage track section 180, it is decelerated by the end stop assembly 194. The end stop assembly 194 performs two tasks. First, the assembly 194 absorbs the momentum of the vehicle(s) 110 in the train so as to decelerate it so that the relative motion of the vehicle(s) 110 and the linkage track section 180 becomes zero. Second, the assembly 194 with end stop retention mechanism 196 also ensures that the vehicle(s) 110 stays on the linkage track section 180 during the linkage rotation. Once the vehicle(s) 110 is stopped, it needs to be held in place at the second end 184 of the track section 180 to ensure that the relative speed between the vehicle(s) 110 and the linkage track section 180 remains zero throughout the rotation of the mechanism/system 140. This task can be performed by the end stop retention assembly 196 with a specific end stop design and/or with use of pneumatic brakes or the like.

After the vehicle(s) 110 has passed the careen brake 190 and before or while the vehicle deceleration is happening at the end stop assembly 194, the locking pin 132 (or other portion of assembly 130 using alternate capture designs) is disengaged to allow the four-bar linkage assembly 149 to move freely. This process can happen simultaneously because the vehicle(s) 110 is fully constrained and cannot come off the linkage track section 180 even if it has not fully stopped. Such a simultaneous action will allow the perceived motion of the vehicle(s) 110 to continue even though the vehicle(s) 110 has stopped on the linkage track section 180 (relative motion becomes zero when captured by retention mechanism 196).

Figure 3:
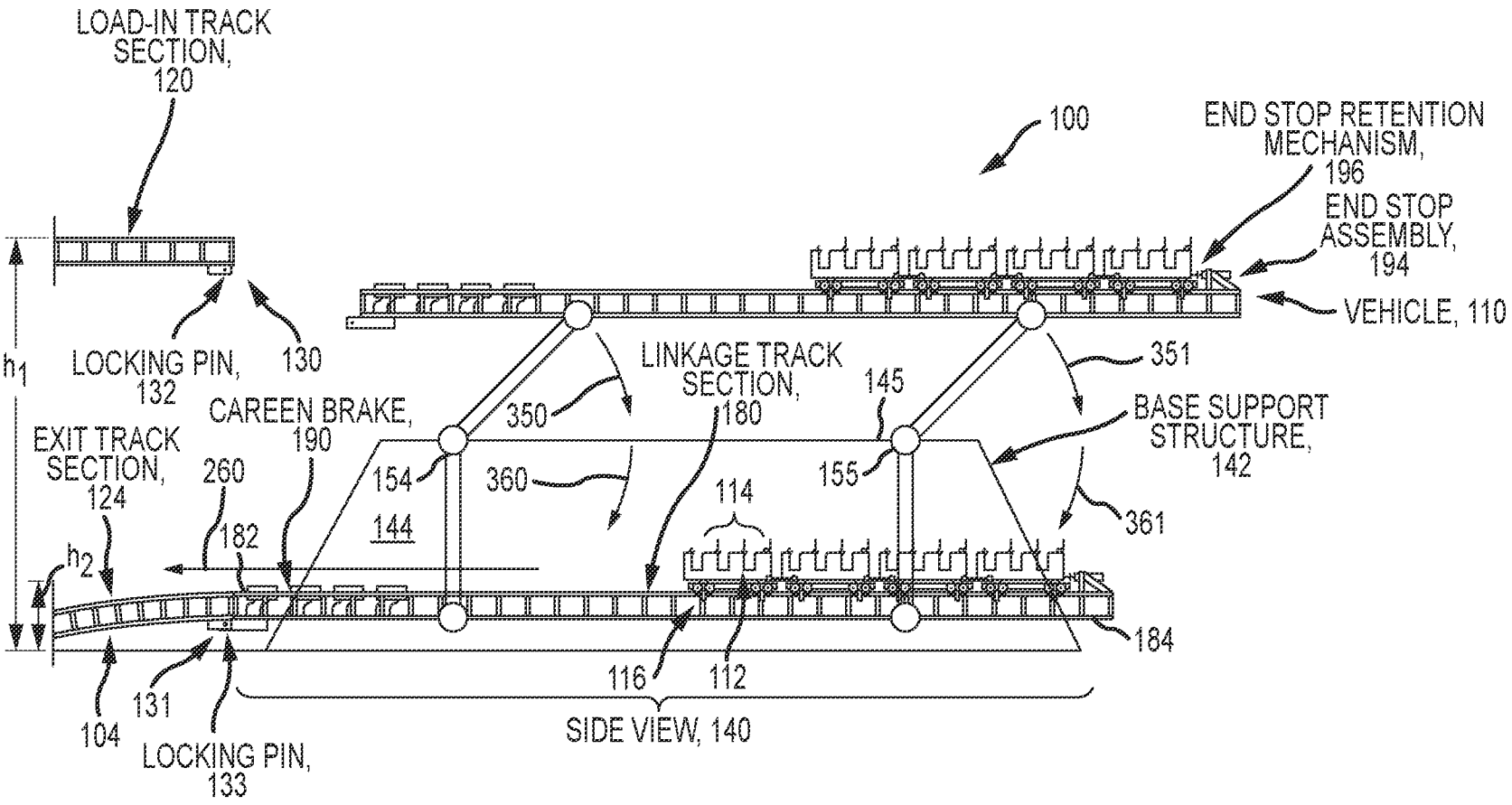
FIG. 3 illustrates the park ride of FIGS. 1A and 1B during a portion of the elevation transition or drop and swing provided by the drop swing propulsion system operations (e.g., showing a portion of the full transition shown in FIG. 2)

FIG. 3 illustrates the park ride 100 of FIGS. 1A and 1B during a portion of the elevation transition or drop and swing, with arrows 350, 351, 360, and 361, provided by the drop swing propulsion system 140 and during its operations (e.g., showing a portion of the full transition shown in FIG. 2 from the first elevation, $h_1$, to the second, lower elevation, $h_2$). As shown, the linkage track section 180 rotates about the linkage support points, i.e., where the links are pivotally coupled to the support structure 142. This is seen with arm 150 rotating 350, 360 about coupling member 154 and arm 151 rotating 351, 361 about coupling member 155 (with members 154, 155 attached to and supported on upper edge 145 of the sidewall 144 of the base support structure 142).

Once the swing of the links (e.g., arms 150, 151, and 161) is within the last 90 degrees of the 180 degree rotation, the holding brake/end stop retention mechanism 196 for the train and vehicle 110 is released because the acceleration of the four-bar linkage assembly 149 will hold the train and vehicle 110 against the end stop of assembly 194. This point in the rotation may be after the rotation shown with arrows 350, 351 where arms/links 150, 151 are parallel with the track section 180 as well as the upper edge 145 of the sidewall 144.

Figure 4:
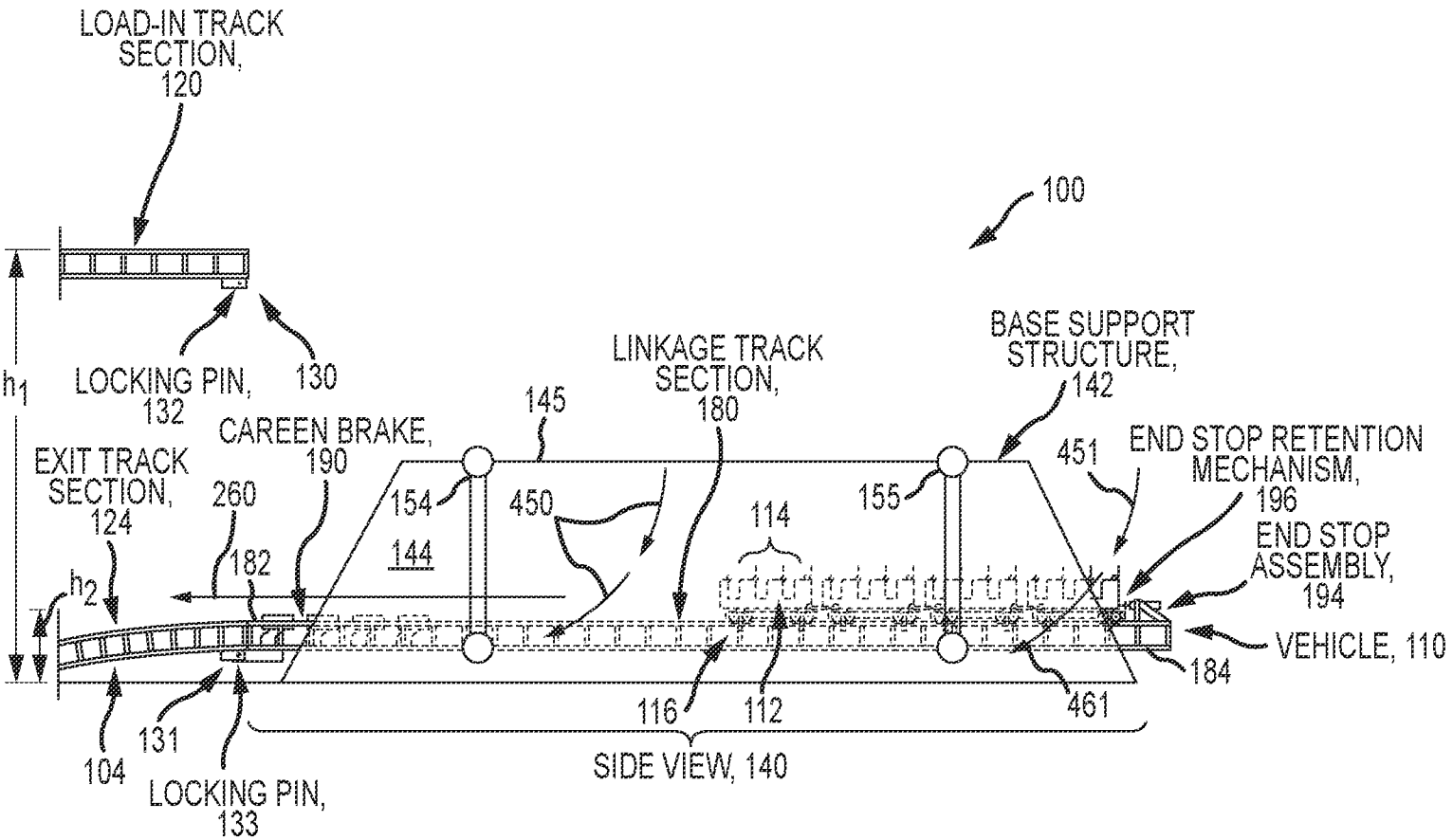
FIG. 4 illustrates the park ride of FIGS. 1A and 1B during a final portion of the elevation transition or drop and swing provided by the drop swing propulsion system operations (e.g., showing a portion of the full transition shown in FIG. 2)

When the linkage track section 180 reaches the end of rotation (or the arms/links 150, 151, 161 have rotated 180 degrees from the initial or load position in which they are directed vertically up as shown in FIG. 1A), it is decelerated (e.g., by a buffer, eddy current brakes, or the like and/or by operation of the actuators/motors of the coupling members 154, 155, 165 used to drive the arms/links 150, 151, 161) to a stop in alignment with the exit track section 124. FIG. 4 illustrates the park ride 100 of FIGS. 1A and 1B during this final portion of the elevation transition or drop and swing, with arrows 450, 451, and 461, provided by the drop swing propulsion system 140 and during its operations (e.g., showing a final portion of the full transition shown in FIG. 2 from the first elevation, $h_1$, to the second, lower elevation, $h_2$).

Since the hold brake/end stop retention mechanism 196 of the end stop assembly 194 has been released, the train and vehicle 110 is free to move, as shown with arrow 260, along the outboard/lead-out portion of the track section 180 and, with its momentum or propulsion from the swing motion (including the final 90 degree swing shown with arrows 450-461), moves towards the exit track section 124. The system 140 is configured to ensure that the linkage track section 180 is properly aligned with the exit track section 124 and the second locking assembly 131 has been operated to interconnect the sections 124, 180 (such as via actuation to insert a locking pin(s) pin 133) before the careen brake is released 190 (e.g., by a system controller) to ensure a collision or derailment of a train does not occur.

If the track sections 124 and 180 are determined, such as by a sensor(s), to be unaligned (or to be not properly aligned), the careen brake 190 will stay in place (or remain activated), and the train with vehicle 110 will be decelerated safely before it can possibly careen off the linkage track section 180. If the linkage track section 180 is determined to be properly aligned (again with a sensor(s) or other means) with the exit track section, the locking assembly 131 is operated to actuate the locking pin 133 to lock the sections 124 and 180 together in the aligned configuration, and the careen brake 190 is deactivated to allow the train with vehicle 110 to continue as shown with arrow 260 onto the exit track section 124 and onto the rest of the ride path defined by the other sections of the track of the park ride 100.

Upon sensing that the train with vehicle 110 has fully traveled off of the linkage track section 180 and onto the exit track section 124 the system controller may trigger operation of the locking member 131 to decouple the track sections 124 and 180 (e.g., by movement or disengagement of the locking pin(s) 133). Then, the system controller will trigger operations of the coupling members 158, 159, and 169 (or another device, not shown) or their actuators/motors to rotate the linkage assembly 149 back into the loading position/stage of operations (as shown in FIGS. 1A and 1B), including sensing proper alignment of track sections 120 and 180 and operation of the first locking assembly 130 to couple the track sections 120 and 180 together (such as with engagement of the locking pin(s) 132) prior to the loading of a next vehicle 110 or train of such vehicles 110.

In some cases, to ensure that the controller/control system can perform all these control tasks in time to allow the vehicle 110 to pass uninterrupted, the swing or linkage track section 180 is designed to have a length that ensures the safety systems can properly check in and allow the vehicle 100 to pass seamlessly through the system 140 without interrupting the rider experience (i.e., without stopping the vehicle's motion in the ride 100, with it being understood that although the vehicle 100 may have zero motion relative to the track, the vehicle 100 is still moving with the dropping and swinging track from one elevation to another lower one). It should also be understood that a full 180-degree swing is not required in all embodiments of the park ride 100, as other embodiments may utilize a swing in the range of greater than 0 degrees up to 180 degrees to achieve a change in direction along with addition of energy to propel the vehicle 110. These other implementations are not shown but are readily understood with an understanding of the ride 100 in hand by one skilled in the arts.

Figure 5:
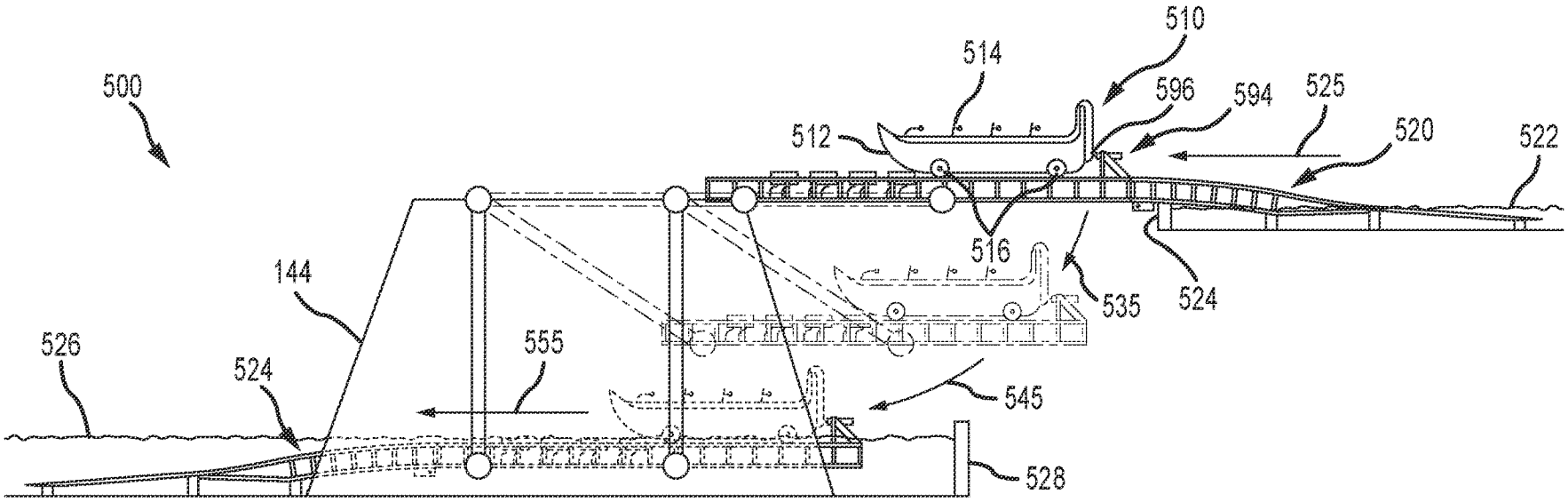
FIG. 5 illustrates with a side view another exemplary park ride similar to that shown in FIGS. 1A and 2 but implemented with a same direction configuration using the drop swing propulsion system to transition (drop and swing) a passenger vehicle from a load-in track section to an exit track section at a lower elevation.
Figure 6:
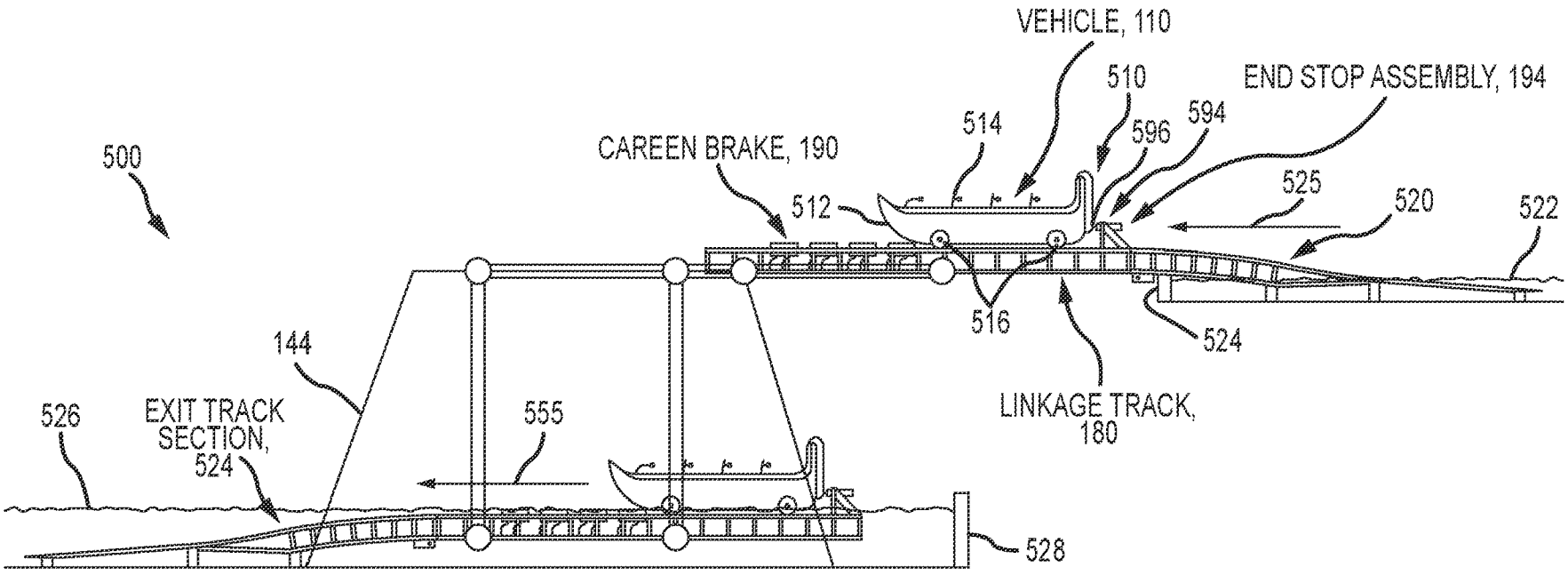
FIG. 6 illustrates, similar to FIG. 1A, a side view of the park ride of FIG. 5.

Instead of changing a vehicle's direction, the drop swing propulsion mechanism may be implemented in park rides with a same direction configuration. FIG. 5 illustrates with a side view another exemplary park ride 500 similar to that shown in FIGS. 1A and 2 but implemented with a same direction configuration using the drop swing propulsion system 140 to transition (drop and swing) a vehicle 510 from a load-in track section 520 to an exit track section 524 (from a first elevation coinciding with the horizontal plane containing the load-in track section 520 to a second, lower elevation coinciding with the horizontal plane containing the exit track section 524 (as discussed above with reference to FIG. 1A). FIG. 6 illustrates the ride 500 similar to the ride 100 in FIG. 1A showing the loaded system 140 prior to its operation to drop and swing the vehicle 510. The configuration of ride 500 allows the vehicle 510 to exit the mechanism 140 going the same direction it entered as shown with arrows 525 and 555 showing direction of travel for the vehicle 510 being the same. The drop swing propulsion system 140 of ride 100 may be used in ride 500 and are, thus, labeled with matching numbers and not described again in detail.

As shown, the park ride 500 is configured as a water ride, but it could also be implemented as a roller coaster as shown in FIG. 1A (or the ride 100 may be implemented as a water ride in some cases). Hence, the vehicle 510 is provided with a body/hull 512 that is adapted for floatation with passenger seats/restraints 514 facing the direction of travel 525 (but may face any desired direction). A bogie or set of wheels 516 is provided at the bottom of the body/hull 512 to rollably engage track in the ride 500. Particularly, the ride 500 includes the load-in track section 520 to engage and guide the vehicle 510 toward the end of a flume/channel structure 524 containing a volume of water 522 (e.g., water flowing in direction 525 at a desired rate).

The end of the load-in track 520 is coupled with first locking assembly 130 and its actuation pin(s) 131 to the end 184 of the linkage track section 180 such that the vehicle 510 rolls from the load-in track section 520 onto the linkage track section 180. The end stop assembly 194 then is positioned (e.g., rotated upward into position shown in FIG. 5) so that the end stop retention mechanism 196 captures/ retains (at least temporarily) the vehicle prior to (or in initial phase) of drop and swing. Once the system 140 is triggered to perform the drop and swing as shown with arrows 535 and 545, the end stop retention mechanism 196 may release the vehicle 510 such that momentum/energy from drop and swing is added to the vehicle 555 to cause it to roll off the linkage track section 180 and onto the exit track section 524 and into the water 526 in the flume/channel structure 528 in the direction of travel shown with arrow 555. The water 526 may be caused to flow in the direction 555, too, and the exit track section 524 is optional in some water ride designs (e.g., the system 140 may release into water 526 with a controlled splashing or in a less guided manner).

As shown in FIG. 5, with the park ride 500 configured as a water ride, the boat/vehicle 510 enters 525 the drop swing propulsion system/mechanism 140 from the right (or a first direction) and exits 555 the system/mechanism 140 towards the left, allowing the vehicle 510 to continue to travel in the same direction in which it started (still moving in the first direction or left to right in this non-limiting example). This configuration operates in the same manner as the direction change configuration shown for ride 100 with a few adjustments or modifications.

Since the mechanism/system 140 is only rotating 90 degrees (as shown in FIGS. 5 and 6 but may be nearly any angle less than about 90 degrees such as 15 to 75 degrees and up to 90 degrees) instead of the 180 degrees shown for the direction change configuration ride 100, the boat/vehicle 510 is stopped at the end 184 of the linkage track section 180 nearest to the load-in track section 520. This means that the vehicle 510 is preferably stopped without using the end stop assembly 194, which may be achieved in a variety of ways such as with the use of the careen brake 190. Once the boat/vehicle 510 is stopped, the end stop assembly 194 is moved into place and the retention mechanism 196 is used to prevent the boat/vehicle 510 from rolling off the back of the linkage track section 180 as well as to ensure the momentum from the swing motion is transmitted to the vehicle/boat 510.

The procedure for ensuring the vehicle 510 transfers onto the exit track section 524 safely may be the same for the ride 500 as for ride 100 where the ride 500 is adapted to ensure that the linkage track section 180 is properly aligned with the exit track section 524 before the careen brake 190 is released to ensure a collision or derailment does not occur. This is particularly true when the ride 500 is configured as a roller coaster-type ride rather than the water ride shown. For the water ride configuration of ride 500 (or of ride 100 with direction changing), the exit strategy may be made less complicated to suit a desired ride experience. For example, if the boat/vehicle 510 is going to continue to continue on a track 524 after the drop swing propulsion system 140 then it is essentially acting as a roller coaster for this portion of the ride path and above release method discussed for ride 100 may be utilized. If the desired experience is a splash down (similar to a typical boat ride drop into water), the exit track section 524 does not need to be included in the ride 500 because the boat/vehicle 510 will be floating on water 526 in flume/channel 528 before it reaches the end of the linkage track section 180 as the mechanism 140 is positioned to make the final swing 545 of the section 180 with the vehicle 510 into the flume/channel 528 and water 526.

Figure 7:
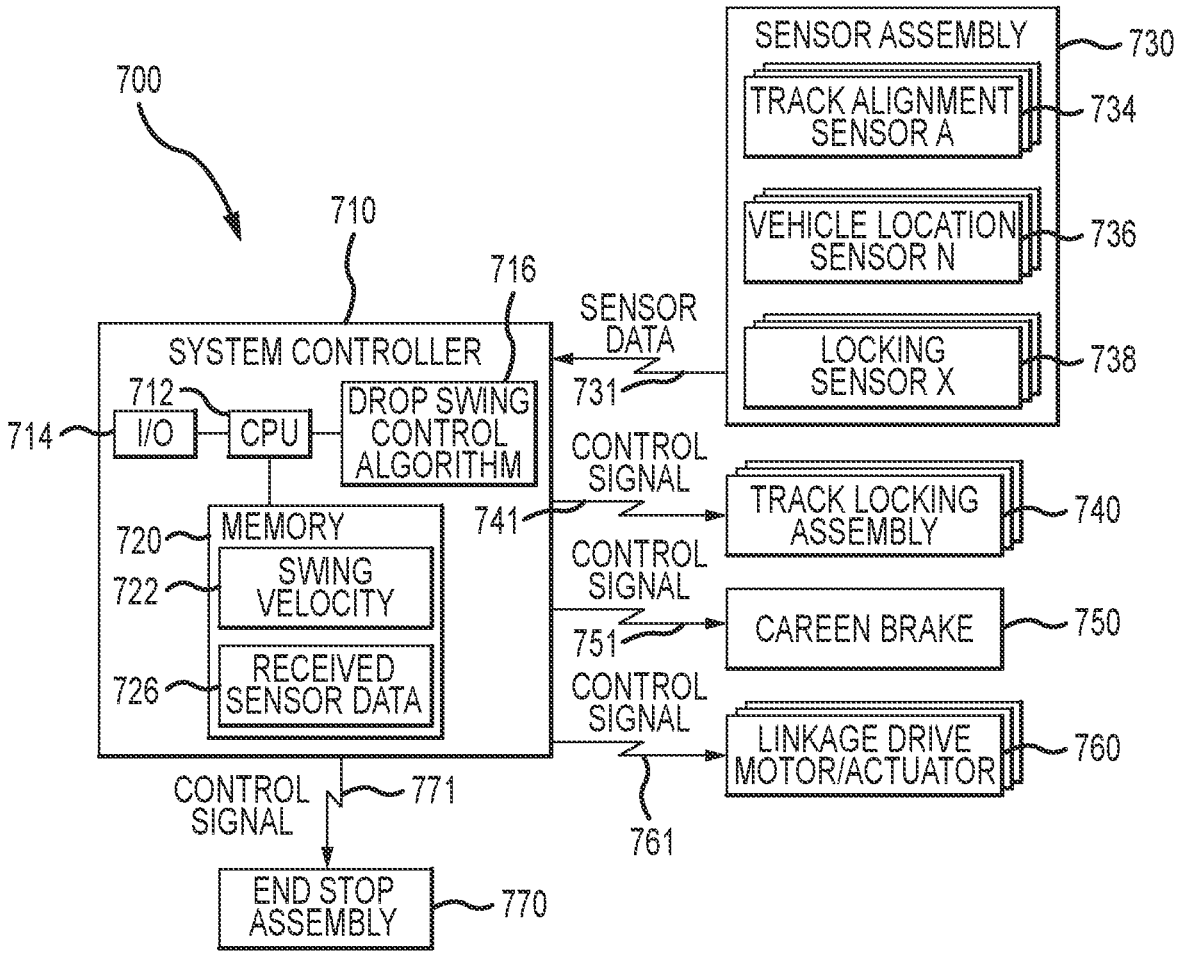
FIG. 7 illustrates a functional block or schematic diagram of a park ride with a drop swing propulsion mechanism/system highlighting the control steps and timing of operations of the system components.

FIG. 7 illustrates a functional block or schematic diagram of a park ride 700 with a drop swing propulsion mechanism/system highlighting the control steps and timing of operations of the system's components (as may be used to control operations of ride 100 or ride 500). As shown, the park ride 700 includes a system controller 710 receiving sensory data 731 from a sensor assembly 730 and, after processing this data, generating and transmitting control signals 741, 751, 761, and 771 to the system's components including the track locking assemblies 740, the careen brake 750, the linkage drive motor(s)/actuator(s), and the end stop assembly 770, respectively.

The controller 710 may take the form of nearly any computing device(s) with processing and data storage functionalities. In ride 700, the controller 710 includes a processor 712 managing operations of input/output (I/O) devices 714 that may take the form of a monitor/display device, a keyboard, a mouse, a touchscreen, and/or voice-based input devices useful for allowing an operator of the controller 710 to interact with system data and to input settings (such as the swing velocity 722 and the like). The processor 712 also operates to execute code or instructions in memory/data storage 720 to provide the functions of a drop swing control algorithm 716 that processes sensor data 731 and other information/variable to generate control signals 741, 751, 761, and 771. The controller 710 also includes memory/data storage 720 (or has access to such memory), and the processor 712 manages access to and data storage in and retrieval from the memory 720. Particularly, the memory 720 is shown being used for storing control parameters for the drop swing propulsion system including the swing velocity for operating the drive motors/actuators 760.

The memory 720 is also used to store the sensor data 726 received as shown with arrow 731 from the sensory assembly 730. Specifically, the park ride 700 includes a sensory assembly/system 730 for performing sensing operating parameters of the ride that are used by the algorithm 716 to control operations of the drop swing propulsion mechanism's components. As shown, the sensory assembly 730 includes track alignment sensors 734 that are used to sense the present alignment status between the load-in track section and the linkage track section as well between the linkage track section and the exit track section. The sensor data 731 may indicate proper alignment of these pairs of track sections or indicate that alignment has not yet been achieved.

The sensor assembly 730 also includes vehicle location sensors 736 that operate to sense the present location of a vehicle or a train of vehicles, depending on the ride design, within a drop swing propulsion system (such as system 140 in FIGS. 1A-6). For example, the sensors 736 may provide sensor data 731 indicating that a loading vehicle 110 (or train of such vehicles) is fully upon the linkage track section or in a position relative to the careen brake 190 and/or end stop assembly 194. The sensors 736 may also provide sensor data 731 indicating that a vehicle 110 (or a train of such vehicles) exiting the drop and swing propulsion system has moved wholly off of the linkage track section 190 (onto exit track section 124 or into the flume/chute 528). Additionally, the sensor assembly 730 includes locking sensors 738 providing sensor data 731 indicating a current operating status or state of locking assemblies (track locking assemblies 130 and 131 and the end stop retention mechanism 196, for example).

The drop swing control algorithm 716 is configured to process the received sensor data 726 along with predefined operating parameters such as swing velocity 722 to control the operations, and timing of such operations, of the drop swing propulsion system to achieve a desired ride effect, including adding energy to or propelling a vehicle exiting the system. To this end, it may be useful to discuss exemplary operations of the ride 700 when operating with a direction change configuration. Prior to loading, the controller 710 operates with control signal 761 the linkage drive motors/actuators 760 to rotate the links/arms of the linkage assembly so as to position an end of the linkage track section 180 next to an open end of the load-in track. A track alignment sensor 734 provides sensor data 731 indicating when proper alignment has been achieved, and, in response to an alignment determination or verification, the algorithm 716 generates a control signal 741 to the appropriate track locking assembly 740 to couple or lock the linkage track section to the load-in track section.

At this point, a next vehicle (or train) may be loaded onto the linkage track section 180. The vehicle location sensor 736 provides sensor data 731 that the algorithm 716 processes to determine when a vehicle (or train) is properly located on the linkage track section 180 (e.g., at or near the end stop assembly). In response to such a determination, the algorithm 716 generates the control signal 751 to activate the careen brake 750 and then a signal 771 to operate the end stop assembly 770 to capture/retain the vehicle on the linkage track section (the sensors 736 may also provide an indication of when relative motion is zero between the vehicle and the linkage track section).

When the vehicle is captured and to avoid halting motion, the drop and swing motion is initiated by the algorithm 716 transmitting a control signal 741 to cause the track locking assembly to decouple the load-in track from the linkage track section. Next, the control signal 761 is generated to operate the linkage drive motors/actuators (at the swing velocity 722) to cause the links/arms to rotate through the 180-degree rotation (or some value between 90 and 180 degrees) or to provide the drop and swing motion of the linkage track section and the vehicle (or train) supported thereupon.

The sensor assembly 730 includes one or more sensors to provide sensor data 731 indicating when the links/arms have reached the 90-degree point of the rotation (or have 90 degrees left to rotate), which corresponds to when the links/arms are co-planar with the upper edge of the base support walls in the ride 100 or when the links/arms are in a horizontal plane. In response to such sensor data 731, the algorithm 716 acts to generate a control signal 771 to operate the end stop assembly 770 to decouple or unlock the vehicle (or train) so that the momentum from the swinging motion can be added to the vehicle. This release of the vehicle may be provided at the 90-degree point or any time after this point is reached to practice the ride 700.

Next, the algorithm 716 processes sensor data 731 from the track alignment sensors 734 to determine when the linkage track section is aligned with exit track section. Once this alignment is detected, the algorithm 716 generates a control signal 741 to cause the appropriate track locking assembly to couple the linkage track section to the exit track section and, once properly coupled (which may also be detected by sensors in assembly 730), the algorithm 716 generates a control signal 751 to deactivate or release the careen brake 750 to allow the vehicle (or train) to travel off the linkage track section with added energy provided by the drop swing propulsion system.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

The proposed drop swing propulsion system or mechanism is a feature that can be used on roller coasters, water rides, or any other type of attraction (labeled a "park ride" herein) where a vehicle usually sits on or in a guide track. The inventor recognized that in the past there have been many features added to roller coasters and similar rides to try to enhance or change the experience including the drop track and the tilt track. The drop track feature used on some roller coasters consists of a horizontal section of track where the vehicle is stopped and then moved vertically to a lower area providing a "free fall" experience. Once on the lower level, the vehicle is transitioned off the horizontal track section continuing along the main track. The tile track feature consists of a horizontal section of track where, similar to the drop track feature, the vehicle stops and is held in place. The track section is then rotated 90 degrees so that the track section and vehicle on the track are vertical. The vertical tilting track aligns with a static vertical main track that continues into more traditional elements. Once the tracks are aligned in the vertical section, the vehicle is released by gravity onto the main coaster track.

While useful to achieve some differing experiences, rides with the new drop swing propulsion system provide a number of new rider sensations and advantages over these prior roller coaster designs. First, the drop swing propulsion mechanism may be operated so as to provide an uninterrupted vehicle motion. The design of the mechanism does not require the vehicle to be stopped when entering or exiting the mechanism (e.g., moving onto and off of the vehicle support or linkage track section), which allows the vehicle to be in motion throughout the experience provided by this new mechanism. The drop and the tilt mechanisms of prior coasters required that the vehicle be parked and held in place before, during, and after the mechanism performs motion of the track. Such a stop in motion can take the rider of the vehicle out of the ride experience and requires the ride designers to mask the limitations of the system, and this can drive up costs and can limit the story that can be told through the ride experience.

Second, the drop swing propulsion mechanism is configured to add energy to the vehicle or to propel it upon its release or at the end of the combination drop and swing motion of the linkage track section and the vehicle(s) supported upon this track section. In contrast, prior roller coaster designs, including those with a drop track feature or with a tilt track feature, are really only ride experience mechanisms that do not add any propelling energy to the vehicles.

Third, unlike other ride designs, the drop swing propulsion system can be used in a variety of configurations. This includes being able to change the direction the vehicle is moving or keeping it moving in the same direction. The system can also be used on a variety of ride types such as roller coasters, boat rides, or other rides that include a vehicle on a track. In contrast, the tilt track discussed above is specific to roller coaster, and the drop track is limited to the "free fall" experience. The drop swing propulsion mechanism can provide a unique launch experience for a roller coaster-type ride and also for a boat-type vehicle into water in a channel or flume.

Fourth, the drop swing propulsion mechanism provides a unique, immersive ride experience that can set a ride apart from anything achieved in prior rides. One can imagine a train out of control that "drops off" the end for a broken section of track. Just before it hits the ground, a superhero, robot, or alien craft catches the train and slingshots the train onto a different track provided below the broken section. This type of experience can be provided due to the continuous train (vehicle) motion provided with the new propulsion mechanism. Continuous motion was not provided in the drop or the tilt designs and would have to be simulated in some way (e.g., via projection techniques, with a motion base, or the like), taking away from the rider's experience. In a water ride, a vehicle may be crossing a rickety rope bridge when the bridge suddenly collapses. The new drop swing propulsion mechanism can be used to swing the vehicle (which may take the form of a boat with wheels or a bogie assembly) forward as if one side of the bridge was still attached and to propel the vehicle safely to the water below the bridge without having to stop (as would be the case with prior designs). The creative possibilities with the new system are nearly endless with the lack of delay time being one of the aspects that sets the system apart.

I claim:

1. A park ride for propelling a vehicle using a combined drop and swing motion, comprising:

a passenger vehicle configured for rolling upon track components defining a ride path;

a load-in track section in the ride path engaging and supporting the passenger vehicle at a first elevation while the vehicle travels in a first direction along the ride path;

a linkage track section; and a linkage assembly coupled to the linkage track section, wherein the linkage assembly first operates to position the linkage track section in a first position at the first elevation that is adjacent the load-in track section to receive and support the passenger vehicle and second operates to drop and swing the linkage track section with the passenger vehicle to a second position, at a second elevation less than the first elevation by a predefined amount, from which the passenger vehicle is released from the load-in track with energy generated by the drop and swing of the linkage track section, wherein the linkage assembly is rotated through a rotation angle to drop and swing the linkage track section from the first elevation to the second elevation while retaining the linkage track section in a horizontal plane during the drop and swing movement.

2. The park ride of claim 1, wherein the linkage assembly comprises a four-bar linkage that is operated to provide the drop and swing of the linkage track section.

3. The park ride of claim 2, wherein the linkage track section provides a first link of the four-bar linkage and wherein a base support structure proximate to the second position provides a second link of the four-bar linkage.

4. The park ride of claim 3, wherein the four-bar linkage further comprises a pair of spaced apart and parallel elongated arms providing third and fourth links of the four-bar linkage and wherein each of the elongated arms is pivotably coupled at a first end to the base support structure and at a second end to the linkage track section.

5. The park ride of claim 4, further comprising coupling members to provide the pivotal coupling of the elongated arms to the base support structure and to the linkage track section and at least one motor for driving rotation of the elongated arms at a desired speed during the drop and swing of the linkage track section.

6. The park ride of claim 2, wherein the four-bar linkage is rotated through an angle in the range of greater than 0 degrees to 180 degrees during the drop and swing of the linkage track section and wherein the passenger vehicle is released from the linkage track section traveling in a second direction opposite the first direction.

7. The park ride of claim 6, further comprising an end stop assembly on the linkage track section operating to retain the passenger vehicle at an end of the linkage track section distal from the load-in section until the four-bar linkage enters a final 90-degree portion of the drop and swing of the linkage track section.

8. The park ride of claim 6, further comprising a careen brake activated after the passenger vehicle is at an end of the linkage track section distal from the load-in section until a time in the drop and swing of the linkage track section prior to the release of the passenger vehicle with the linkage track section at the second position.

9. The park ride of claim 2, wherein the four-bar linkage is rotated through an angle in the range of 0 to 90 degrees during the drop and swing of the linkage track section and wherein the passenger vehicle is released from the linkage track section traveling in a second direction matching the first direction.

10. The park ride of claim 1, further comprising an exit track section at the second elevation, wherein an end of the linkage track section is positioned adjacent to and aligned with an end of the exit track section when the linkage track section is positioned at the second position, whereby the passenger vehicle is released onto the exit track section to travel upon the ride path using the energy generated by the drop and swing of the linkage track section for propulsion.

11. The park ride of claim 1, wherein the passenger vehicle is a water ride vehicle, wherein the park ride further comprises a flume or channel of water, and wherein the linkage track section is at least partially submerged in the water of the flume or channel when moved by the drop and swing into the second position.

12. A park ride for propelling a passenger vehicle via a swing during a drop in elevation, comprising:

at a first elevation, a load-in track section supporting and guiding the passenger vehicle; and a drop swing propulsion assembly including:

a base support structure;

a linkage track section; and a pair of spaced apart and parallel elongated arms, wherein each of the elongated arms is pivotably coupled, via coupling members, at a first end to the base support structure and at a second end to the linkage track section, wherein the base support structure, the linkage track section, and the elongated arms are arranged to each provide a link of a four-bar linkage, wherein the drop swing propulsion assembly first operates to position the linkage track section in a first position adjacent the load-in track section to receive the passenger vehicle and second operates to drop and swing the linkage track section with the passenger vehicle to a second position via concurrent rotation of the elongated arms through a predefined rotation angle, wherein the linkage track section has a horizontal plane orientation throughout the drop and swing while the elongated arms are rotated through the rotation angle, and wherein the linkage track section in the second position is at a second elevation less than the first elevation.

13. The park ride of claim 12, wherein the predefined rotation angle is in the range of 90 to 180 degrees and wherein the passenger vehicle is released from the linkage track section traveling in a direction opposite a direction the passenger vehicle traveled in the load-in section.

14. The park ride of claim 13, further comprising an end stop assembly on the linkage track section operating to retain the passenger vehicle at an end of the linkage track section distal from the load-in section until the four-bar linkage enters a final 90-degree portion of the drop and swing of the linkage track section.

15. The park ride of claim 13, further comprising a careen brake activated after the passenger vehicle is at an end of the linkage track section distal from the load-in section until a time in the drop and swing of the linkage track section prior to the release of the passenger vehicle with the linkage track section at the second position.

16. The park ride of claim 12, wherein the predefined rotation angle is in the range of 0 to 90 degrees and wherein the passenger vehicle is released from the linkage track section traveling in a direction matching a direction the passenger vehicle traveled in the load-in section.

17. The park ride of claim 12, further comprising an exit track section at the second elevation, wherein an end of the linkage track section is positioned adjacent to and aligned with an end of the exit track section when the linkage track section is positioned at the second position, whereby the passenger vehicle is released onto the exit track section to travel upon the ride path using energy generated by the drop and swing of the linkage track section.

18. The park ride of claim 12, wherein the passenger vehicle is a water ride vehicle, wherein the park ride further comprises a flume or channel of water, and wherein the linkage track section is at least partially submerged in the water of the flume or channel when moved by the drop and swing into the second position.

19. A park ride for propelling a passenger vehicle via a swing during a drop in elevation, comprising:

a drop swing propulsion assembly configured as a four-bar linkage with a first link provided by a linkage track section, a second link provided by a base support structure, and third and fourth links provided by linkage arms each pivotally pivotably coupled at opposite ends to the linkage track section and the base support structure;

a sensor assembly; and a system controller performing the steps of:

processing first sensor data output by the sensor assembly to verify alignment of the linkage track section with a load-in track section;

processing second sensor data output by the sensor assembly to determine when the passenger vehicle is positioned at and captured at an end of the linkage track section; and generating a control signal to operate the drop swing propulsion assembly to rotate the third and fourth links through a rotation angle to drop and swing the linkage track section from a first elevation to a lower second elevation while retaining the linkage track section in a horizontal orientation.

20. The park ride of claim 19, wherein the rotation angle is in the range of greater than 0 degrees to 180 degrees and wherein the system controller performs the further step of processing third sensor data output by the sensor assembly to determine when the third and fourth links are within a final 90-degree portion of the rotation angle and, in response, to operate an end stop assembly to release the passenger vehicle from the end of the linkage track section, whereby the passenger vehicle is released from the linkage track section with momentum provided by the drop and swing.

21. The park ride of claim 1, further comprising an exit track section at the second elevation, wherein the passenger vehicle is released onto the exit track section with propulsion generated by the drop and swing, and wherein the passenger vehicle is released onto the exit track section in a second direction opposite the first direction.

22. The park ride of claim 1, further comprising a careen brake spaced apart from the passenger vehicle and over which the passenger vehicle traverses before the drop and swing.

23. The park ride of claim 1, wherein the linkage assembly comprises a pivot, and wherein the linkage assembly is rotated about the pivot to drop and swing the linkage track section from the first elevation to the second elevation while retaining the linkage track section in the horizontal plane during the drop and swing movement.

* * * * *